US005915852A

United States Patent [19]

Rogers

[11] Patent Number: 5,915,852

[45] **Date of Patent: *Jun. 29, 1999**

[54] EVIDENCE MARKER AND MARKING SYSTEM

[76] Inventor: Richard J. Rogers, P.O. Box 18276, Tucson, Ariz. 85731

[ * ] Notice: This patent is subject to a terminal disclaimer.

[21] Appl. No.: 09/126,906

[22] Filed: Jul. 31, 1998

Related U.S. Application Data

[63] Continuation-in-part of application No. 08/515,394, Aug. 15, 1995, Pat. No. 5,787,616.

[51] Int. Cl.[6] ..... G09F 1/00

[52] U.S. Cl. ..... 40/124.01; 40/612; 40/584; 116/209; 283/117

[58] Field of Search ..... 40/124.01, 610, 40/584, 612, 299; 116/209; 33/506, 476, 458, 494; 283/117, 115

[56] References Cited

U.S. PATENT DOCUMENTS

| | | | |
|---|---|---|---|
| 342,303 | 5/1886 | Morrison | 33/458 X |
| 2,555,741 | 6/1951 | Greene | 33/458 X |
| 3,371,647 | 3/1968 | Shopbell | 116/209 |
| 3,890,716 | 6/1975 | Hatch | 33/1 D |
| 4,060,929 | 12/1977 | Meyer et al. | 446/11 |
| 4,173,086 | 11/1979 | Hempfing | 40/645 X |

FOREIGN PATENT DOCUMENTS

| | | | |
|---|---|---|---|
| 829351 | 6/1938 | France | 40/FOR 100 |

*Primary Examiner*—Cassandra H. Davis
*Attorney, Agent, or Firm*—Gregory J. Nelson

[57] ABSTRACT

A marker for placement adjacent an evidence item at a crime scene having upstanding panels connected to form a free-standing unit. A base panel extends from the lower edge of the upstanding panels and is imprinted with reference indicia such as suitable scales and a photographic target. The base panel may have a cut-out so the item of evidence may be positioned within the cut-out for better reference. The surfaces of the panels carry indicia such as numbers or letters for identification. The markers may be placed on a horizontal surface or suspended by use of a fastener from a vertical surface. The markers are provided to law enforcement personnel in kits containing multiple sequentially imprinted markers which are nestable and stackable.

8 Claims, 4 Drawing Sheets

EVIDENCE MARKER AND MARKING SYSTEM

CROSS REFERENCE TO RELATED APPLICATION

This application is a continuation-in-part of Ser. No. 08/515,394, filed Aug. 15, 1995, entitled "Evidence Marker", now U.S. Pat. No. 5,787,616.

BACKGROUND OF THE INVENTION

Field of the Invention

The present invention relates to a marking device and more particularly relates to a marker for use by law enforcement investigators and forensic personnel for marking and identifying evidence at a crime scene.

Recent widely publicized criminal trials have underscored the importance of the proper handling of crime scene evidence. Conventional practice is for law enforcement investigators and forensic technicians to separately mark and identify each object or item of evidence at a crime scene. For example, a blood spot or a bullet hole is normally marked by investigating personnel by use of index cards or adhesive-backed materials such as those sold under the designation Post-It™ notes". These cards or notes are inscribed with an identification number and placed adjacent the particular evidence item. Conventional practice is for photographers to take one or more photos of the item next to the marker so the photographs may be subsequently used during investigations or at trial. The use of markers of this type has obvious disadvantages. Conventional index cards or adhesive-backed notes are easily affected by weather and the environment. A wind or even a breeze can blow these type of markers away from the evidence scene. The writing on such markers can become illegible in the case of rain or if placed in a damp location. Also, such markers generally do not provide the subsequent viewer of a photograph a frame of reference as to the size of the particular evidence item. Accordingly, it is generally necessary for an investigator to place some type of reference item such as a ruler or common object such as a coin adjacent the marker for dimensional reference.

Another disadvantage of conventional evidence marking practice is that the markers do not provide the viewer of a photograph taken of the marker and evidence an indication of the orientation of the photograph. Therefore, the viewer can not determine whether the photograph was taken in direct alignment with the evidence item or whether the camera was positioned at an angle which may tend to distort the photographic representation of the evidence. Thus, a photograph may be subject to attack on foundational grounds and the evidentiary value compromised.

Because of these disadvantages, there clearly exists a need for a convenient, easy to use evidence marker which will not be affected by moisture and which also provides suitable reference markings which later may be used for reference to confirm the accuracy of photographs taken of the marker and the evidence.

While various freestanding signs can be found in the prior art, none are intended for use as an evidence marker. For example, a search of the prior art disclosed the following as being representative of these type signs:

U.S. Pat. No. 1,943,295 shows a three-legged advertising frame and paperweight made from metal stock. The surfaces of the three projecting faces are provided with desired letter or advertising.

U.S. Pat. No. 4,182,063 discloses a foldable sign for motorists which may be collapsed in accordion fashion and which may be unfolded to expose the desired message.

U.S. Pat. No. 4,270,291 shows a sign construction which has a panel which is securable to a window. Message bearing panels are hinged to the upper panel to allow the user to select and display the appropriate sign.

U.S. Pat. No. 4,541,190 shows a foldable, collapsible traffic display sign. The device has three rectangular panels which are connected by two folding hinges. Each face of the display carries an appropriate warning, such as "HELP", "STOP" or the like.

U.S. Pat. No. 4,977,697 shows a traffic barrier which is a unitary panel having a plurality of folds to permit the device to be placed in an A-frame configuration displaying appropriate message panels.

U.S. Pat. No. 5,056,520 shows a self-standing placard which has a message on its front surface. A curved fastener on the back of the placard cooperates with a stiff spacing member to support the placard.

From the foregoing, it will be appreciated that the prior art shows various freestanding signs and advertising devices which carry numbers, advertising messages and the like.

SUMMARY OF THE INVENTION

Briefly, the marker of the present invention provides an evidence marker which comprises a pair of oppositely facing panels joined along their upper edge generally to form a freestanding marker having panels arranged in an inverted V or tent-like configuration. Each of the outer, exposed faces of the panels carries appropriate indicia such as a number or a letter. A generally planar base member extends from the bottom or lower end of at least one of the panels. The base member assists in supporting the evidence marker and in the use-position is disposed along a surface such as a wall or floor. The base which may be rectangular or include a cut-out also carries appropriate indicia including reference markings for indicating size and a photographic alignment target or indicator. The marker is preferably integrally formed and made of a suitable resistant material such as plastic and defines one or more apertures so that the marker can be secured to a wall or suspended on a rod or stake.

In use, investigators are provided a set of evidence markers according to the present invention, the set being provided with sequential or serial indica such as numbers 1 to 100.

BRIEF DESCRIPTION OF THE DRAWINGS

The above and other objects and advantages of the present invention will be more fully appreciated from the following description, claims and drawings in which:

DETAILED DESCRIPTION OF THE INVENTION

Figure 1:
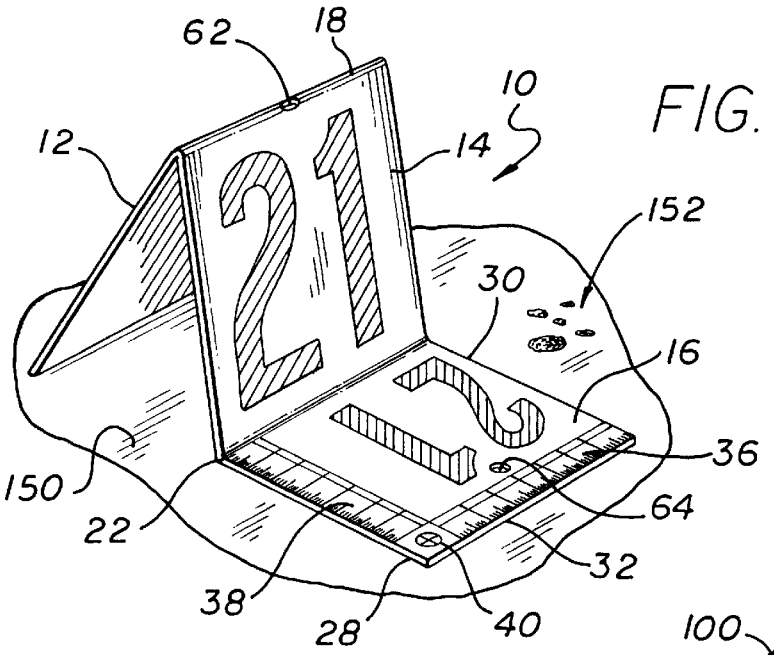
FIG. 1 is a perspective view of an evidence marker according to the present invention shown in a use-position next to an item of evidence.

Turning to FIG. 1, a preferred embodiment of the evidence identification marker of the present invention is shown and is generally designated by the numeral 10. The marker is a unitary structure having generally rectangular panels 12, 14 and 16. Panels 12 and 14 are joined along their upper edge 18 forming a generally inverted V or tent-like configuration. Panels 12 and 14 are angularly disposed relative to one another at an angle of approximately 30° to 45° and form a freestanding construction. The outer surfaces of panels 12 and 14 carry appropriate indicia and in this case represented by a numeral "21". The indicia may be any suitable numeric, alphabetic or other marking. Generally, the evidence markers of the present invention will be provided to law enforcement personnel in sets, typically of 100, with each marker in the set bearing a different numeral for convenience of identification and differentiation.

Base panel 16 is also generally rectangular and is attached to the lower edge of panel 14 at edge 22. The upwardly disposed surface of panel 16 also carries alphanumeric indicia the same as on panels 12 and 14 and is shown as the numeral "21".

Figure 3:
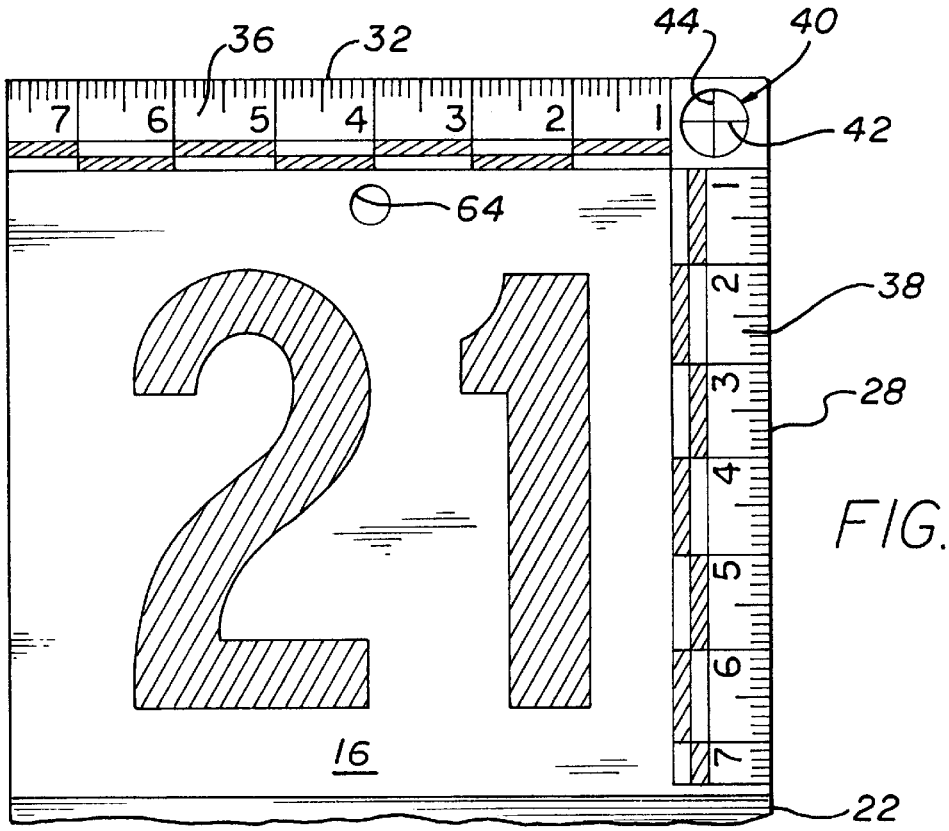
FIG. 3 is a plan view of the base panel of the evidence marker shown in FIGS. 1 or 2.

Panel 16 has opposite edges 28 and 30 and outer edge 32. As seen in FIG. 3, a suitable reference scale 36 is disposed along the edge 32, the scale 36 being shown as being in metric increments. Similarly, another scale 38 extends from the corner intersection of edges 32 and 28 and is designated by the numeral 38 and is also suitably graduated in metric increments. A photographic target 40 is disposed adjacent the corner at the intersection of edges 28 and 32. The photographic target is reticular and is shown as a circle having intersecting diametrical lines 42 and 44 which are photo cross-hairs.

The scales 36 and 38 allow the viewer of a photograph taken of the marker and evidence to visually ascertain the approximate size of the evidence item. The photographic target 40 allows the viewer photograph taken of the marker in evidence to approximately determine the orientation of the camera with respect to the marker. For example, if the camera is not directly aligned above the marker and target, the photographic target 40 will tend to elongate in the photograph in one direction or the other.

A hole 62 is provided along edge 18 and another hole 64 is provided adjacent edge 32 of panel 16. As will be explained with reference to FIGS. 5 and 6, these holes are provided to position the marker in several positions of use and make the marker much more versatile and convenient to use.

Figure 4:
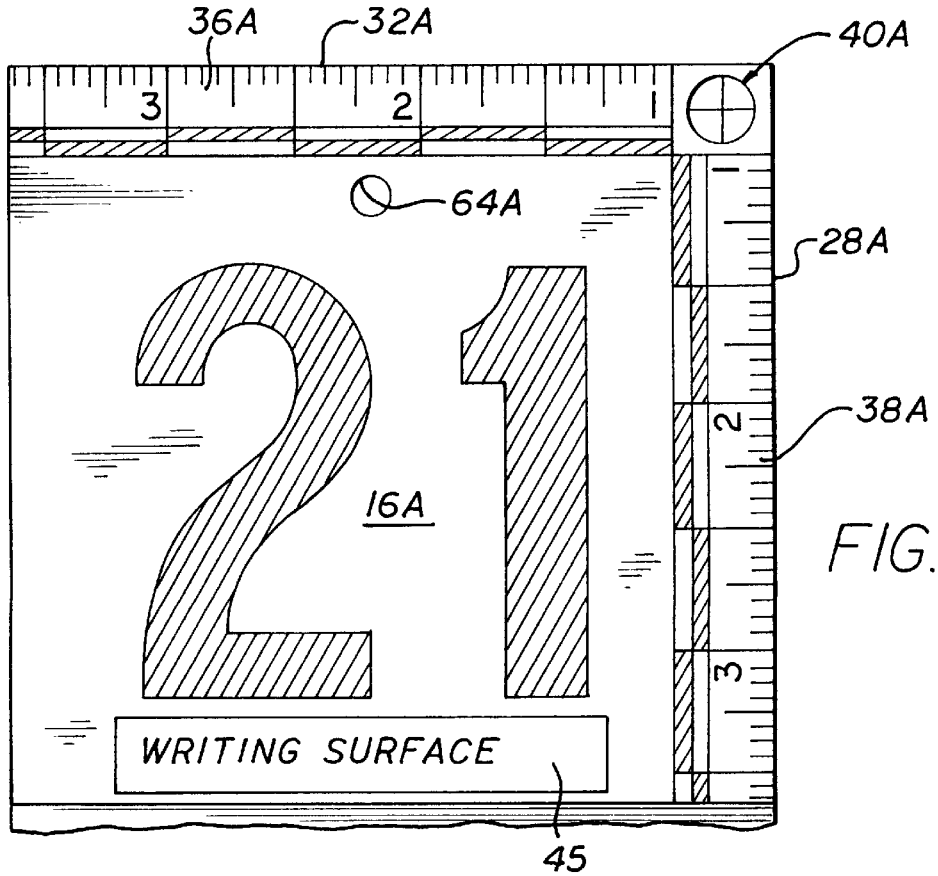
FIG. 4 is a plan view of the base panel of the evidence marker shown in FIGS. 1 and 2 carrying alternate indicia.

FIG. 4 shows a view of panel 16A which is similar to the panel 16 shown in FIG. 3. The elements of the panel shown in FIG. 4 are identified by the same numerals with the letter "A" appended. The panel 16A again has identifying indicia in the form of numeral "21". Suitable scales 36A and 38A extend oppositely from the intersection of panel edges 32A and 28A. In this embodiment, the reference scales 36A, 38A are graduated in inches rather than in metric graduations. A photographic indicator 40A is also provided in the upper right corner of the panel 16A. It will also be apparent that the scales 36A, 38A may be graduated in any desired manner and that scale 36A, for example, could be in metric graduations and scale 38A in English graduations. An area 45 is provided on panel 16A for application of notations. Area 45 may have a surface treated to erasably accept ink or pencil or may be a tape which may be removed and replaced with a fresh section.

Figure 2:
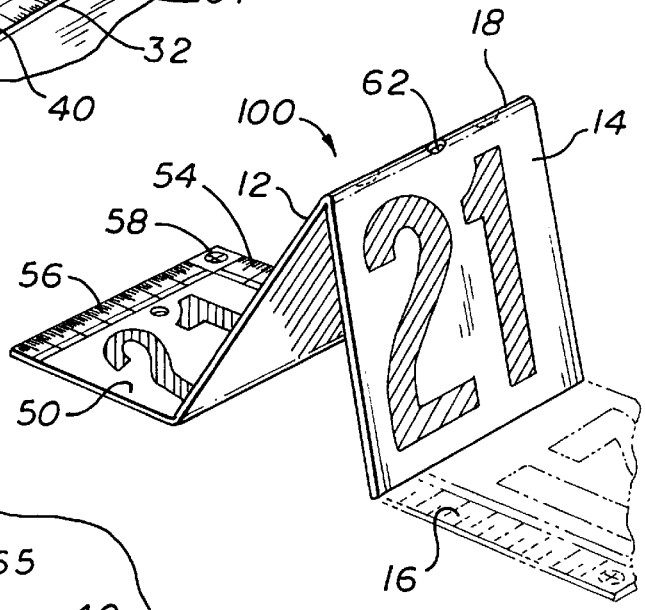
FIG. 2 is a perspective view similar to FIG. 1 showing an alternate embodiment of the present invention.

In FIG. 2, an alternate embodiment of the present invention is shown generally designated by the numeral 100. Again, the same numerals have been used to designate the same or similar components or elements. The evidence marker 100 is constructed in a manner similar to that shown in FIG. 1 having panels 12 and 14 joined along common upper edge 18 to form a freestanding, generally inverted V-structure. The panels are again provided with suitable indicia such as the number "21". Base panel 16 is integrally attached to the lower edge of panel 14 and is provided with indicia and scale and photographic target indicators as has been described above.

A second base member 50 is integrally secured along the lower edge of panel 12. Base panel 50 is again generally rectangular having suitable indicia imprinted thereon. Reference scales 54, 56 are provided along adjacent edges of the base panel and photographic reference indicator or target 58 is also provided in the upper right corner of the base panel as seen in FIG. 2. The embodiment of FIG. 2 is essentially identical to that shown in FIG. 1 with the addition of another projecting base element for stability.

A better understanding of the evidence marker of the present invention will be had from the following description of use.

In FIG. 1 evidence marker 10 is shown in a position of use on a horizontal surface such as a floor 150. The evidence is represented by the numeral 152 and is shown as a plurality of spots such as blood spots. The investigator at the crime scene would select one of the markers and position it on the floor 150 adjacent the evidence 152. As is mentioned above, generally the markers would be provided in sequentially numbered sets to investigators and the investigators would in most cases use the markers in ascending numerical order. Thus, having previously used the marker bearing the numeral "20", the investigator at the crime scene would select the marker bearing the numeral "21" and position it near blood spots 152.

The official photographer at the scene will then take one or more photographs of the marker and the adjacent evidence. The photographer may insure the accuracy of the photographic representation by aligning the camera directly with the target 40. If the photographer takes a photograph at an angle with respect to the target 40, the target 40 will tend to elongate allowing the subsequent viewer of the photograph to determine the angle at which the photograph was taken.

Figure 11:
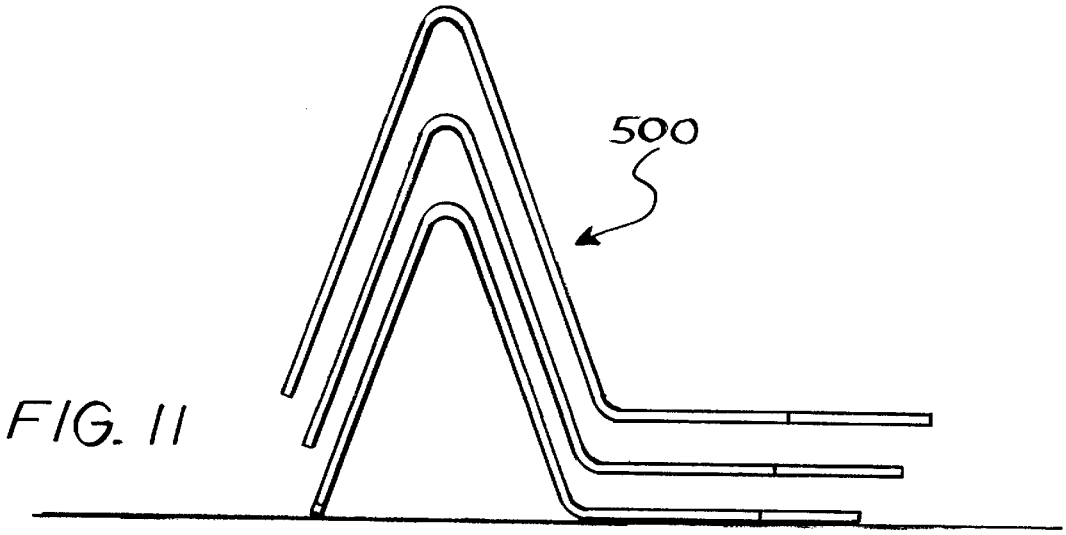
FIG. 11 is a side view illustrating a plurality of evidence markers in a stacked condition.

When the investigation at the crime scene is concluded, the investigator will collect the various markers 10 that have been distributed in the area and retain them for re-use in a subsequent investigation. The configuration of the markers make them easily nestable and stackable as seen in FIG. 11 so they may be stored for re-use in a convenient location such as the trunk of a police vehicle.

Figure 5:
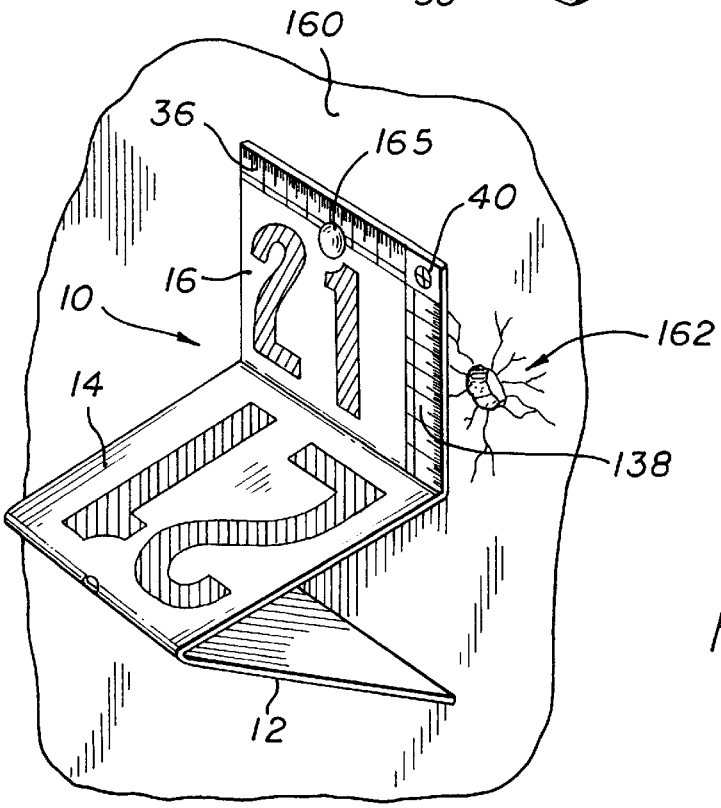
FIG. 5 is a perspective view showing the evidence marker of FIG. 1 in a position of use secured to a vertical surface adjacent an evidence item.

FIG. 5 shows another use position of the marker according to the present invention. In this figure, the marker 10 is shown positioned on a vertical surface such as a wall 160 adjacent evidence item 162 which is a bullet hole in the wall. In this case, the evidence marker is suspended by using a fastener shown as a tack 165 which extends through the hole 64 provided in the base panel 16. Adhesives may also be used to secure the marker against a wall or other surface. Panels 12 and 14 extend outwardly from the vertical surface with their lower edges abutting the surface. The reference numerals "21" are visible on panels 14 and 16. In this orientation, the evidence marker and the item of evidence can be photographed and when the photographed is subsequently viewed, the approximate size of the evidence item can be determined by reference to the scales 36 and 38 and the orientation of the photograph determined by reference to the photographic target 40.

Figure 6:
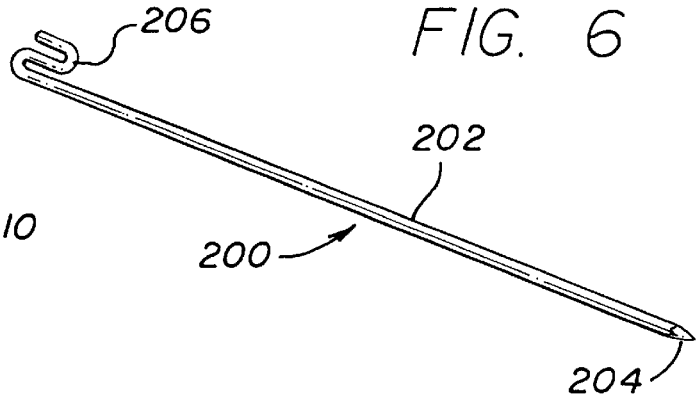
FIG. 6 is a perspective view of a support rod which may be used in connection with the evidence marker of the present invention.
Figure 7:
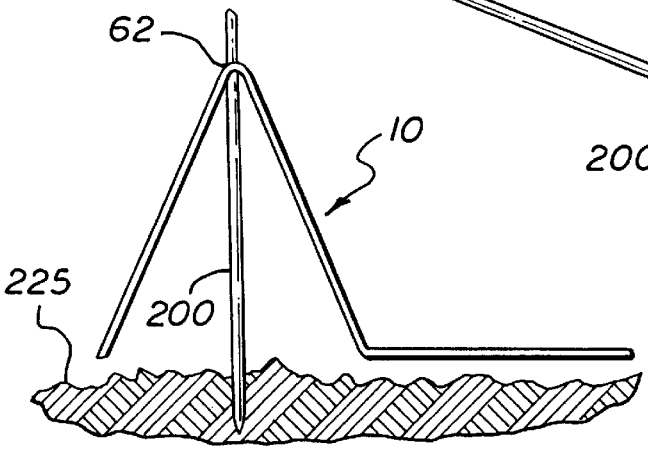
FIG. 7 is a side view showing the evidence marker of FIG. 1 suspended above a ground surface on the support rod of FIG. 6.

The evidence marker of the present invention may also be used as a marker in outdoor locations such as in tall grass or on uneven terrain. When used in these type locations, the marker 10 generally is suspended by a ground stake such as shown in FIG. 6. The ground stake shown in FIG. 6 is generally designated by the numeral 200 and has an elongate shaft 202 with a pointed end 204. The upper end of the stake is formed in a generally U-shaped hook 206. The hook portion 206 may be inserted into the hole 62 defined in the upper common edge 18 of panels 12 and 14. The lower end of the stake 200 may be inserted into the ground 225 as shown in FIG. 7. In FIG. 7, the rough surface of the ground interferes with the placement of the marker and, accordingly, the stake 200 allows the user to position the marker adjacent an item of evidence on the ground without interference.

Figure 8:
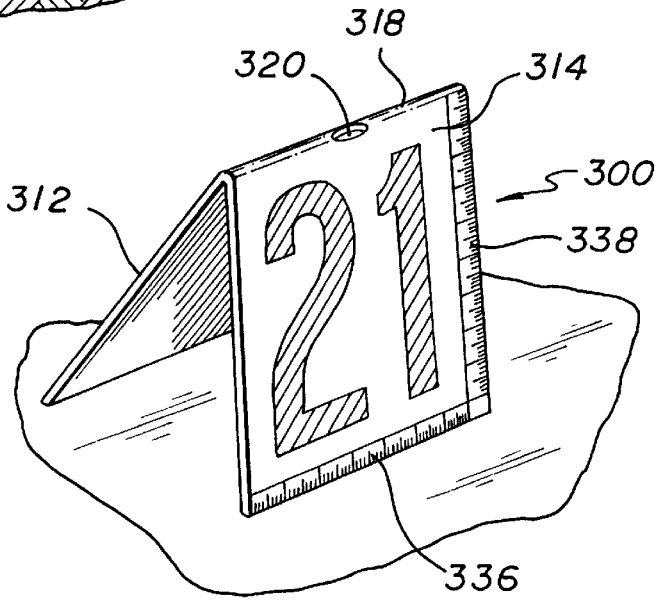
FIG. 8 is a perspective view of another embodiment of the evidence marker.

In FIG. 8 an alternate embodiment is shown designated by the numeral 300 which has opposed panels 312 and 314 joined along common edge 318 to form a freestanding tent or A-frame structure. Indicia such as numeral "21" and scales 336 and 338 are provided adjacent the bottom and side edges of the panels. Aperture 320 is provided at an intermediate location along edge 318.

Figure 9:
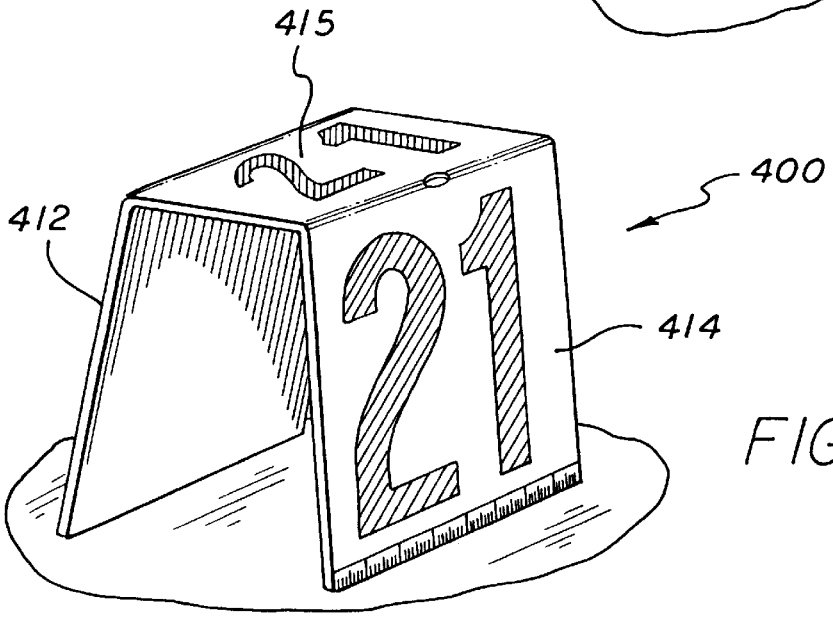
FIG. 9 shows still another embodiment of the evidence marker of the present invention.

FIG. 9 shows yet another embodiment which is indicated by the numeral 400. The construction of the marker includes panels 412 and 414 interconnected by horizontal top panel 415 forming an inverted J-shaped structure. The panels 412, 414 and 415 all carry suitable indicia.

In other respects, the embodiments of FIGS. 8 and 9 are constructed similar to those described above and have essentially the same functional features and advantages.

Figure 10:
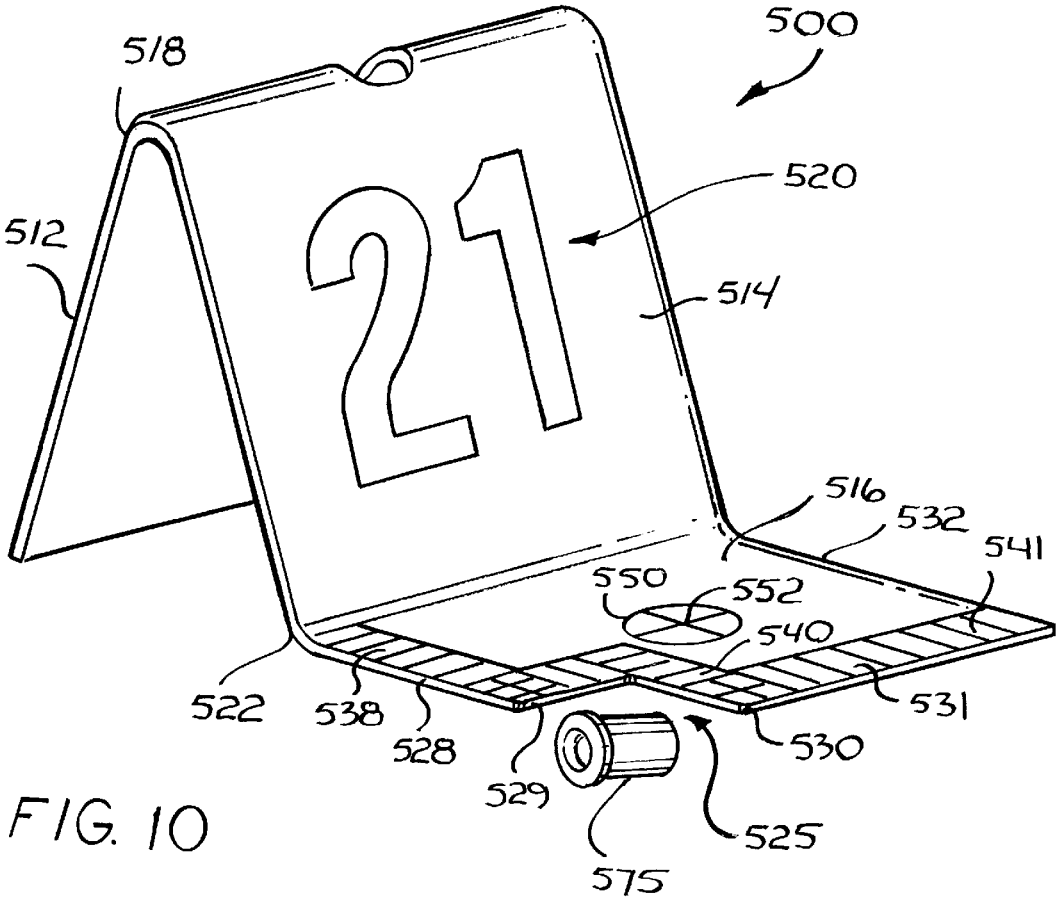
FIG. 10 is a perspective view of yet another embodiment of the evidence identification marker.

In FIG. 10 yet another embodiment is shown which is indicated by the numeral 500 and which is a one-piece rigid structure having rectangular panels 512, 514 and 516. Panels 512 and 514 are joined along their upper edge 518 in a generally inverted Vor tent-like configuration. One or both panels 512 and 514 carry appropriate identification indicia 520 represented by the numeral "87". Base panel 516 is attached to the lower edge of panel 514 at 522. Panel 516 has a rectangular cut-out area at 525 and has edges 528, 529, 530, 531 and 532. Reference scales 538,539, 540 and 541 are disposed on the upper surface of panel 516 adjacent edges 528 to 531. The reference scales may be graduated in any suitable units such as metric units. A photographic target 550 shown as a circle with intersecting cross-hair lines 552 is disposed near the intersection of edges 529 and 530.

In use the evidence identification marker 500 is used as has been described previously with the added advantage that the marker permits positioning of an item of physical evidence such as shell casing 575 in the cut-out area. With some items better dimensional accuracy and more convenient identification can be achieved since both scale 529 and 530 are available for reference.

The evidence marker of the present invention can be fabricated from any suitable material. It is preferred the marker be fabricated from a suitable resistant material such as plastic material such as polystyrene. The markers may be provided in any suitable color such as white, yellow, fluorescent or photo grey. The indicia may be reflective for better visibility. The marker can be manufactured by stamping or cutting an elongate section of the desired material which is then printed with the appropriate indicia. Thereafter, the planar section of imprinted material may be formed into the configuration shown in either FIGS. 1 or 2. This configuration is convenient not only for use at crime scenes but also allows the markers 500 to be stacked in a nesting condition for convenient storage when not in use as illustrated in FIG. 11.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. An evidence identification marker for placement adjacent an evidence item at an investigation site for purposes of identification comprising:

(a) a first generally planar panel having top, bottom and side edges;

(b) a second generally planar panel having top, bottom and side edges, said first and second panels being joined along their top edges to form a generally rigid free-standing inverted V-shaped structure;

(c) a third generally planar panel having side and end edges, said third panel extending from and joined to the bottom edge of one of said first and second panels;

(d) reference indicia on at least one of said panels;

(e) photographic reference markings on at least one of said panels; and (f) a dimensional reference scale on at least one edge of the third panel.

2. The evidence identification marker of claim 1 wherein said marker is plastic.

3. The evidence identification marker of claim 1 wherein said third panel defines a cut-out area.

4. The evidence identification marker of claim 3 wherein the cut-out area is a generally rectangular area.

5. An evidence kit comprising a plurality of markers, each marker comprising:

(a) a first generally planar panel having top, bottom and side edges;

(b) a second generally planar panel having top, bottom and side edges, said first and second panels being joined along their top edges to form a generally rigid free-standing inverted V-shaped structure;

(c) a third generally planar panel extending from and joined to the bottom edge of one of said first and second panels;

(d) reference indicia on at least one of said panels;

(e) photographic reference markings on at least one of said panels; and (f) dimensional reference scale on selected edges of the third panel.

6. The evidence kit of claim 5 wherein said markers may be nestably stacked and individual markers removed and positioned on a surface adjacent an item of evidence.

7. A method of marking physical evidence at a location comprising:

(a) providing an evidence kit comprising:

i. a first generally planar panel having top, bottom and side edges;

ii. a second generally planar panel having top, bottom and side edges, said first and second panels being joined along their top edges to form a generally rigid free-standing inverted V-shaped structure;

iii. a third generally planar panel extending from and joined to the bottom edge of one of said first and second panels;

iv. reference indicia on at least one of said panels;

v. photographic reference markings on at least one of said panels; and vi. dimensional reference scale on selected edges of the third panel; and (b) placing selected markers adjacent items of physical evidence, each of said markers bearing separate reference indicia.

8. The method of claim 7 further including taking a photograph of the item and associated marker using the photographic reference marker.

* * * * *